United States Patent [19]

Ronde et al.

[11] 4,160,311

[45] Jul. 10, 1979

[54] METHOD OF MANUFACTURING A CATHODE RAY TUBE FOR DISPLAYING COLORED PICTURES

[75] Inventors: Hubertus J. Ronde; Peter C. Van Loosdregt, both of Eindhoven, Netherlands

[73] Assignee: U.S. Philips Corporation, New York, N.Y.

[21] Appl. No.: 893,065

[22] Filed: Apr. 3, 1978

Related U.S. Application Data

[63] Continuation of Ser. No. 757,674, Jan. 7, 1977, abandoned.

[30] Foreign Application Priority Data

Jan. 16, 1976 [NL] Netherlands ..... 7600417

[51] Int. Cl.[2] ..... H01J 9/02

[52] U.S. Cl. ..... 29/25.15; 29/25.14

[58] Field of Search ..... 29/25.13, 25.14, 25.15, 29/25.16; 156/630, 633, 634, 644

[56] References Cited

U.S. PATENT DOCUMENTS

| | | | |
|---|---|---|---|
| 3,186,883 | 6/1965 | Frantzen | 156/634 X |
| 3,787,106 | 1/1974 | Schermerhorn | 316/17 |
| 3,799,816 | 3/1974 | Schneble, Jr. et al. | 156/644 |
| 3,923,566 | 12/1975 | Law | 156/644 |
| 4,059,781 | 11/1977 | van Alphen et al. | 313/403 |

*Primary Examiner*—Richard B. Lazarus
*Attorney, Agent, or Firm*—Algy Tamoshunas

[57] ABSTRACT

A method of manufacturing a focusing shadow mask for a color cathode ray tube is disclosed in which two conductive plates, forming the electrode structure, are secured together by insulating material so that they do not contact each other. Prior to assembly, at least one of the plates is provided with a pattern of substantially parallel ridges joined together by strips much thinner than the ridges. The material of the thin strips is removed after the plates are secured together, so that the remaining ridge portions form a set of conductors with the spaces therebetween being aligned with apertures on the other plate to form a plurality of openings for passage of electron beams.

18 Claims, 25 Drawing Figures

METHOD OF MANUFACTURING A CATHODE RAY TUBE FOR DISPLAYING COLORED PICTURES

Figure 1:
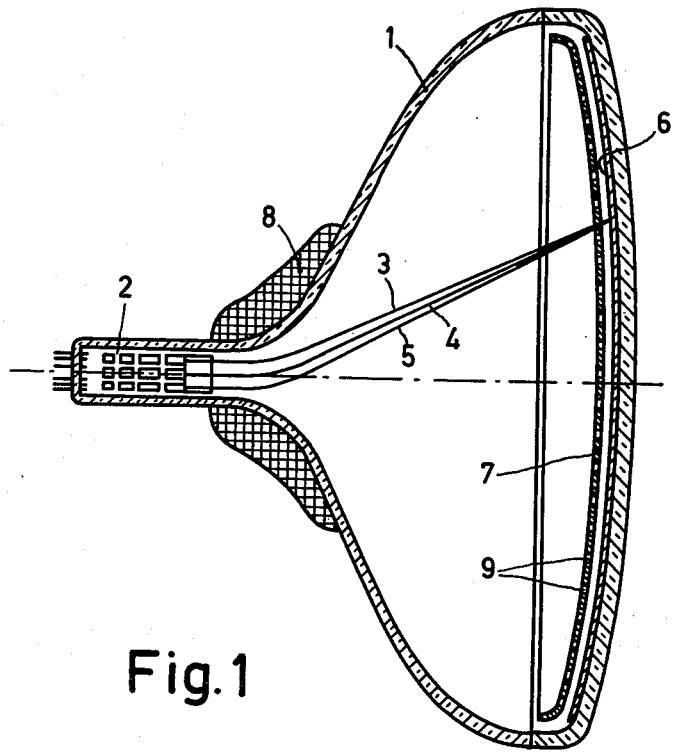

This is a continuation of application Ser. No. 757,674, filed Jan. 7, 1977, now abandoned.

The invention relates to a method of manufacturing a cathode ray tube for displaying colour pictures and comprising in an evacuated envelope means to generate a number of electron beams, a display screen comprising a large number of regions luminescing in different colours, and colour selection means having a large number of apertures which assign each electron beam to luminescent regions of one colour and which include electrodes for forming an electron lens in each aperture.

The invention also relates to a cathode ray tube manufactured according to this method and the colour selection means used in such a cathode ray tube.

Such a cathode ray tube with a focusing type shadow mask is known from the U.S. Pat. No. 3,398,309. The object of past focusing is to increase the brightness of the displayed picture by increasing the transmittance of the colour selection means. In tubes without postfocusing a very large part, for example 80 to 85%, of the electrons in the beams are intercepted by the shadow mask. By the use of postfocusing, the apertures in the colour selection means can be enlarged since the beams are focused as they pass through the apertures. As a result, the electron spots on the screen are considerably smaller than the apertures so that there is sufficient landing tolerance in spite of the increased size of the apertures.

The electron lens which is formed in the apertures in shadow mask of the known tubes is of the unipotential type and as a result requires a rather large voltage difference between the lens electrodes.

Another postfocusing tube is described in U.S. Pat. No. 2,728,024. In this tube, the electron beams pass successively through two grids which consist of parallel conductors, the conductors associated with different grids being at right angles to each other. In this arrangement, the electron beams are successively focused by two electron-optical cylinder lenses which are rotated 90° relative to each other. As a result of the action of both lenses, the electron beams are focused in one direction and are defocused in a direction at right angles thereto.

One drawback of this tube is that it also requires a rather large voltage difference to focus the electron beams. In addition, the two grids do not form a mechanical unit so that the vibration of the grid wires presents great problems. Furthermore, such a tube requires a flat display screen.

it is the object of the invention to provide a method of manufacturing an improved cathode ray tube for displaying colour pictures of the kind mentioned in the preamble.

The invention also makes it possible to make curved, plate-shaped, colour selection means of the usual sizes.

According to the invention, a method of the kind mentioned in the first paragraph is characterized in that the colour selection means is made from a plurality of metal plates which are secured together with the interposition of insulation material so that the plates do not contact each other. in the method of the invention, prior to assembly of the plates at least one of them is provided with a pattern composed of a plurality of substantially parallel ridges with strip-shaped regions of a much smaller thickness between the ridges. The material of the strip-shaped regions is then removed after the plates are secured together.

After the removal of the strip-shaped regions, the remaining ridges form parallel conductive strips which are secured to the other plate or plates while being separated therefrom by an insulator. The resultant assembly forms the electrodes for producing the electron lens.

The colour selection means may be manufactured from two metal plates one of which is provided with apertures and the other with the aforementioned relief pattern. The method includes the step of positioning the plates relative to each other in a manner such that the apertures in one plate are disposed between the ridges of the other plate. The colour selection means is thus formed form an apertured metal plate and conductive strips extending between the apertures. The apertures may be provided in one of the plates at an earlier stage of the process or may be etched simultaneously with the removal of the material of the strip-shaped regions of the other plates by an etching process. The ridges may be provided on two sides of the plate or only on one side which may be either remote from or adjacent the other plate.

The colour selection means according to the invention may also be formed from two plates which are both provided with the relief pattern. In this case, the plates are secured together in a manner such that the ridges extend at an angle of approximately 90° with respect to each other. After removal of the strip-shaped regions, the resultant colour selection means is formed by a grid consisting of two sets of substantially parallel conductors which cross each other. The conductors of one set are insulated from the conductors of the other set at the crossings while the conductors of each set may be mutually interconnected. Upon application of a voltage difference between the sets, a quadrupole lens is formed in each aperture of the colour selection means. Since the electric field is at right angles to the electron path, quadrupole lenses are much stronger than cylinder lenses so that much lower operating voltages than those required by cylinder lenses will suffice. That a quadrupole lens focuses in one direction and defocuses in a direction at right angles thereto is in principle not a drawback when all quadrupoles have the same orientation. In a tube with such a colour selection electrode, the luminescent regions of the display screen preferably have the shape of substantially parallel strips whose longitudinal direction is substantially parallel to the defocusing direction of the quadrapole lenses.

The relief pattern is provided in the plates by means of known techniques, for example, by etching, rolling, spark erosion or moulding.

The great advantage of the method of the invention is that the individual plates are very rigid so that colour selection means of large dimensions and a curved shape can be manufactured. Moreover, the conductive strips are provided against the other plate at the desired distance from each other.

Advantageously the insulation material used in the method is glass which is provided on at least one of the plates in the form of glass powder. The glass powder is subsequently converted into solid glass by a thermal treatment and the excess glass is removed, after removal of the material of the strip-shaped regions.

The glass powder may be provided on the plates, for example, by spraying, silk-screening, settling (depositing) or by means of tape containing glass powder which is known commercially as Vitta. In order to minimize the quantity of excess glass between the plates, the areas which are not to be coated may be covered with a template during spraying or depositing.

An advantageous method for providing the glass coating is to cover one of the plates provided with a relief pattern with an insulator so that only the ridges remain uncovered. The ridges are then coated with glass powder electrophoretically. Thereafter the insulator is removed, the glass powder is converted into solid glass by a thermal treatment and the plate with the glass covered ridges is secured against a second plate. Suitable insulators for use in this process are, inter alia, methacrylate resins, polyimides, beeswax or paraffin.

The electrophoretic coating with glass powder is preferably carried out in an electrophoresis bath which contains an alcohol, preferably methanol, as a carrier liquid in which the glass powder is suspended.

The removal of the excess glass may be carried out by means of powder blasting from both sides so that the glass on the apertured plate or the glass at the crossings of the grid is in the "shadow" of the conductive strips. Excess insulating material or glass as the term is used herein refers to material which has no adhering and insulating functions, for example, the glass present on portions of the conductors other than at the crossings.

Other very suitable insulators for use in the method of the invention are refractory synthetic materials. In another preferred embodiment of the invention, a refractory synthetic foil is provided between the plates as an insulator. The excess synthetic material and the material of the strip regions is then removed. The synthetic material should be refractory because the cathode ray tube reaches temperatures up to 500° C. during securing of the display window to the cone and during evacuating of the tube.

The synthetic foil may also be used as an adhesive for securing the plates together by wetting at least on one side of the synthetic foil with an adhesive for the material of the foil before it is placed between the plates. A number of synthetic materials adhere only after they have been subjected to a thermal treatment which produces gases. It is therefore recommended to provide at least one of the plates with a number of small apertures for the escape of the gases.

Very suitable synthetic materials for this purpose are the polyimides of which the polyimide of 4-4′ diaminodiphenyl ether and 1-2-4-5 benzenetetracarbonic acid dianhydride proves to give particularly good results and is available, inter alia, in a foil form under the name of Kapton.

During assembly, the plates should not contact each other even when the insulation material therebetween becomes soft and must remain insulated from each other. This can be done by maintaining the desired distance between the plates while they are being secured by means of spacing elements. The spacing elements may, for example, be spheres disposed between the ridges.

The provision of an insulating layer may also be done quite differently. If at least one of the plates has an aluminium surface which is at least partly anodized, a suitable insulator is formed by the $Al_2O_3$ layer.

When the material of the strip-shaped regions is not entirely removed, edges are formed at the ridges which screen the insulation material from the electron beams and/or possible barium particles originating from a getter.

Figure 2:
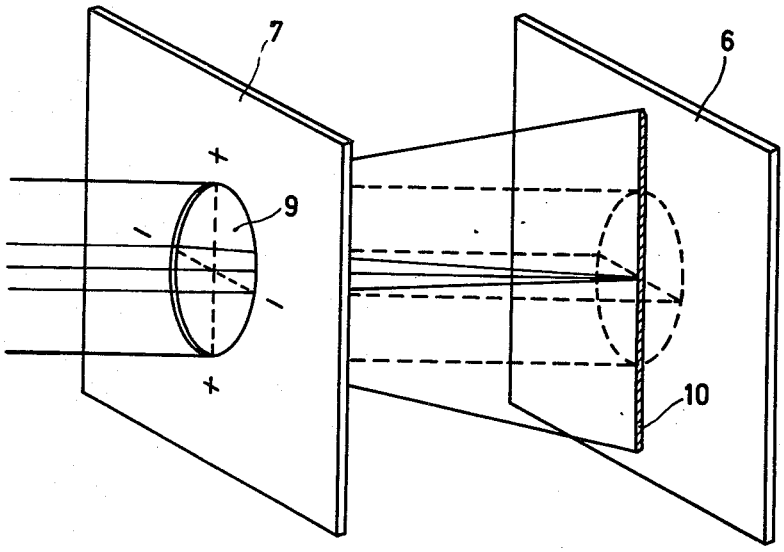
Figure 3A:
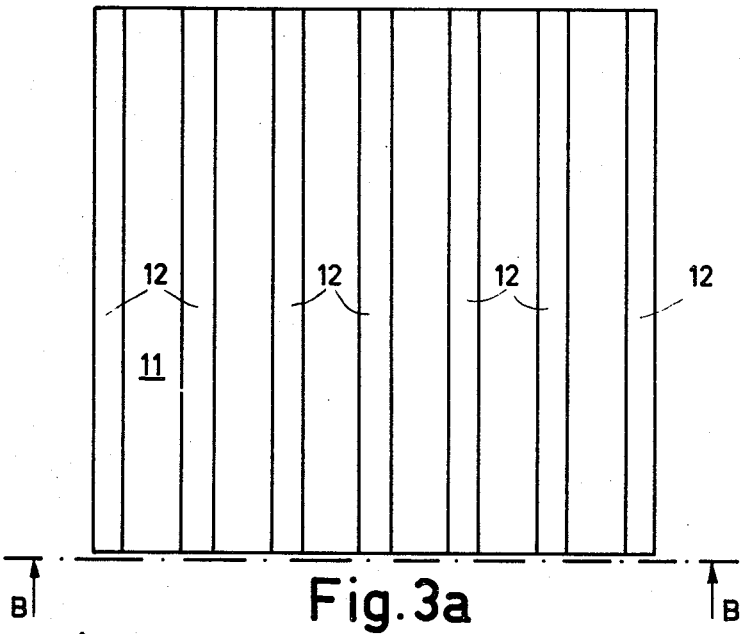
Figure 3B:
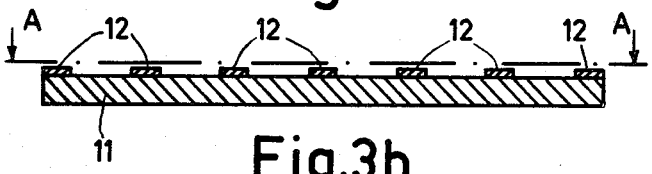
Figure 3C:
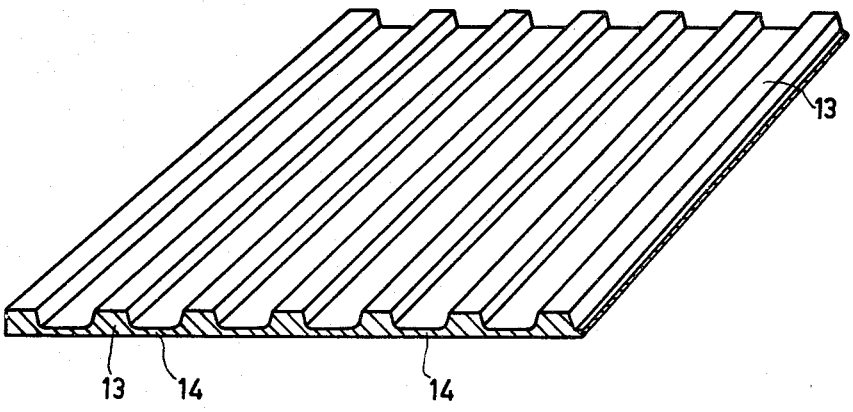
Figure 4:
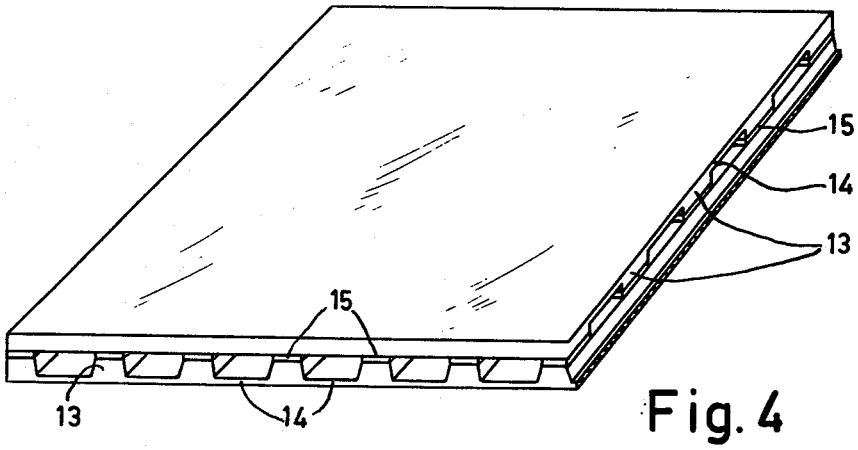
Figure 5A:
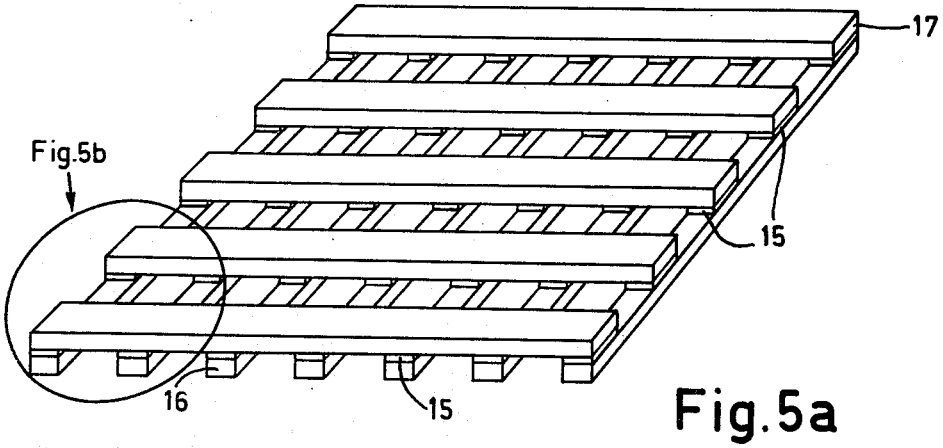
Figure 5B:
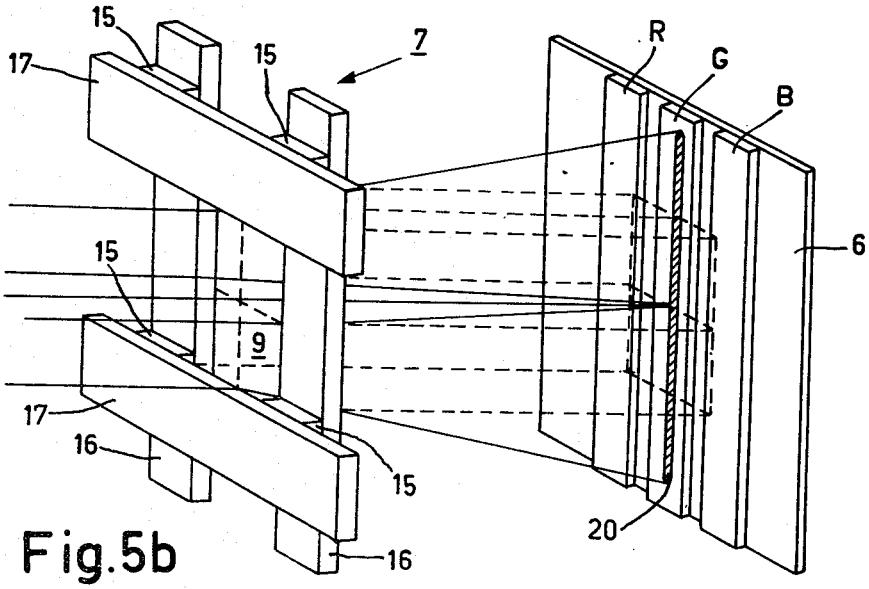
Figure 6A:
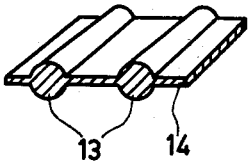
Figure 6B:
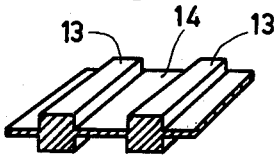
Figure 7A:
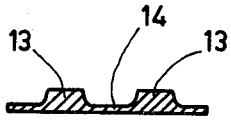
Figure 7B:
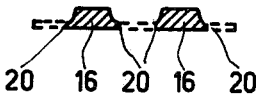
Figure 7C:
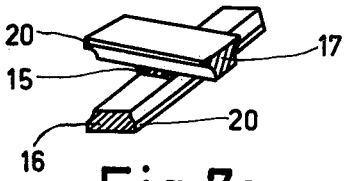
Figure 8:
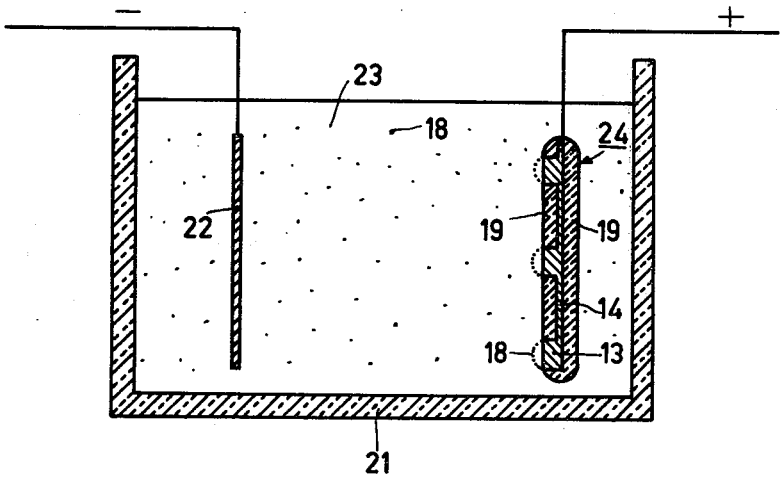
Figure 9:
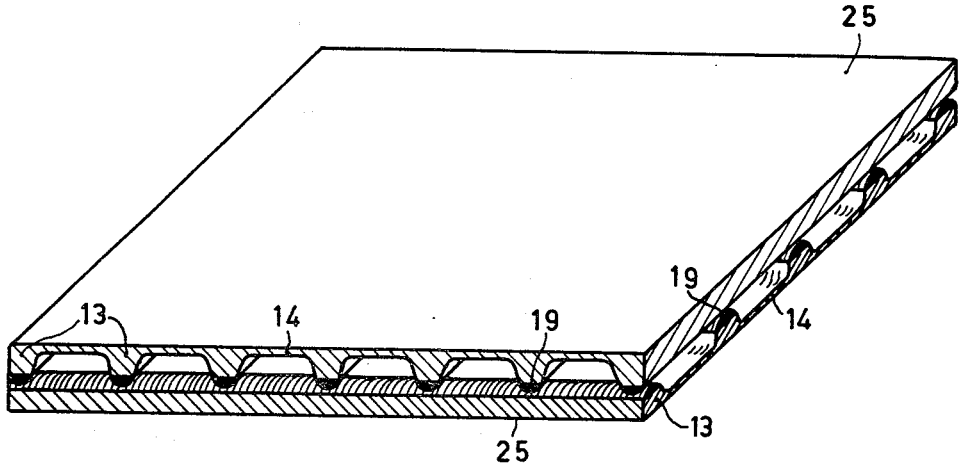
Figure 10:
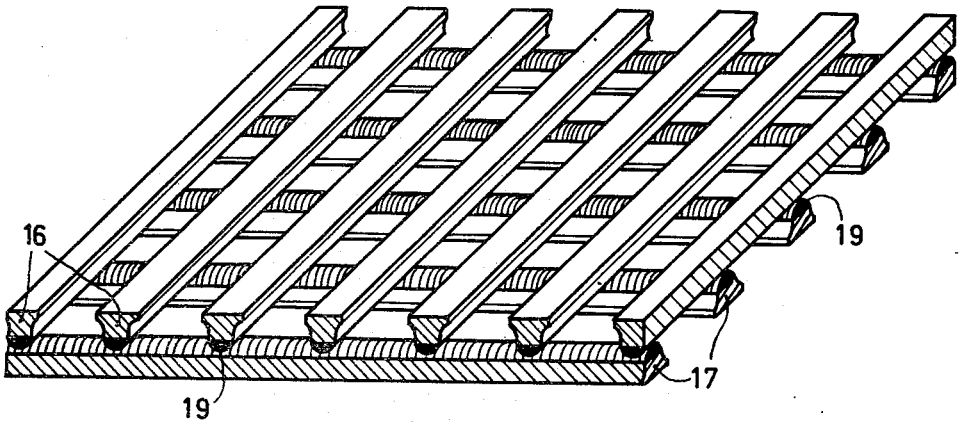
Figure 11:
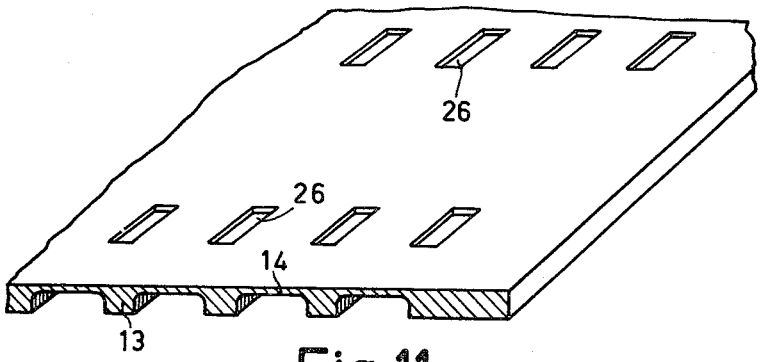
Figure 12:
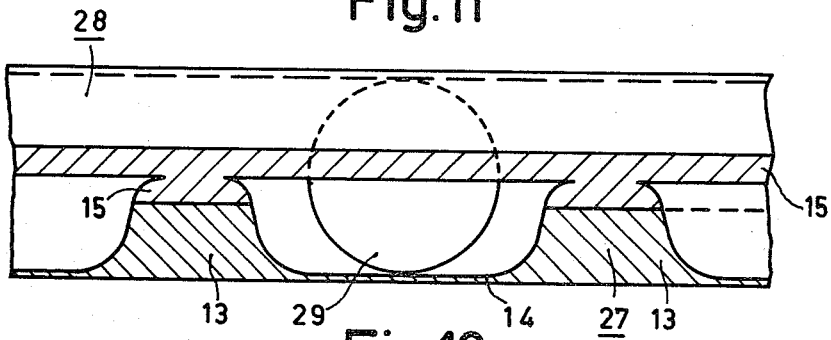
Figure 13:
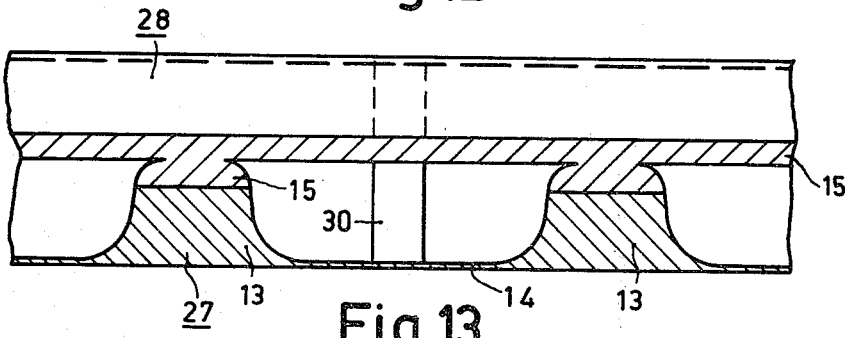
Figure 14:
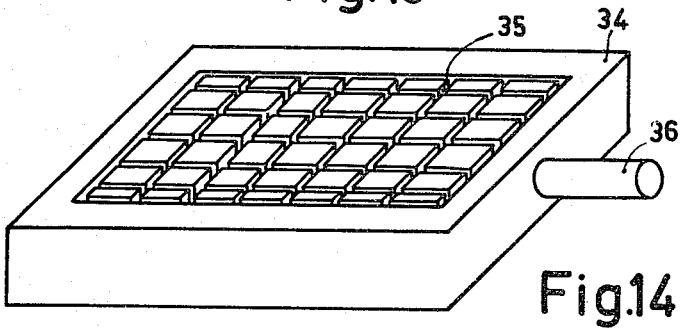
Figure 15A:
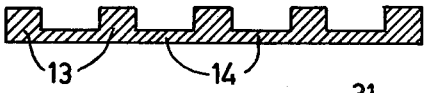
Figure 15B:
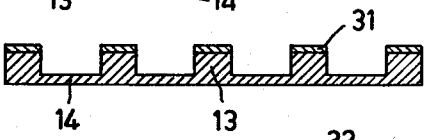
Figure 15C:
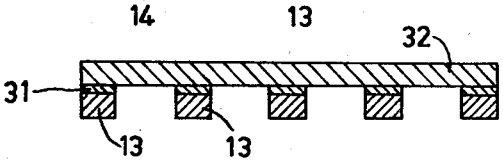
Figure 16A:
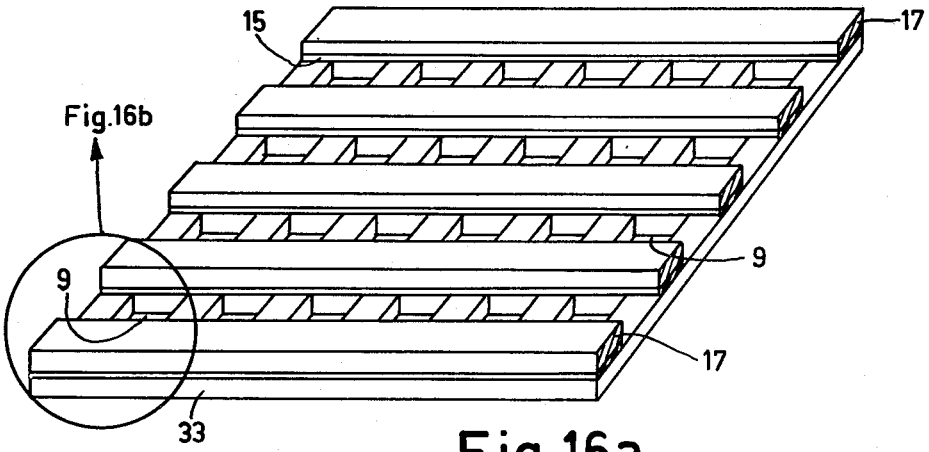

Embodiments of the invention will now be desired by the way of example with reference to the diagrammatic drawings in which:

FIG. 1 shows a cathode ray tube manufactured by a method embodying to the invention, FIG. 2 shows the operation of a quadrupole lens denoted diagrammatically, FIGS. 3*a, b* and *c* show the manufacture in steps of a plate having a relief pattern, FIG. 4 shows two plates as illustrated in FIG. 3*c* secured together, FIG. 5*a* shows a part of a cross grid suitable for colour selection means, FIG. 5*b* shows the operation of such a cross grid, FIGS. 6*a* and 6*b* and 7*a*, 7*b* and 7*c* show a few other possible relief patterns, FIG. 8 shows diagrammatically a method of electrophoretic coating with glass powder, FIGS. 9 and 10 show the manufacture of a part of a cross grid by means of glass powder, FIG. 11 shows an apertured relief plate, FIGS. 12 and 13 show spacing elements, FIG. 14 shows a suction plate for securing the plates together, FIGS. 15*a, b* and *c* show an anodized aluminium plate, and FIGS. 16*a* and *b* show an apertured plate provided with conductive strips.

The cathode ray tube shown in FIG. 1 comprises a glass envelope 1, means 2 for generating three electron beams 3, 4 and 5, a display screen 6, colour selection means 7 and deflection coils 8. The electron beams 3, 4 and 5 are generated in one plane, the plane of the drawing of FIG. 1, and are deflected over the display screen 6 by means of the deflection coils 8. The display screen 6 consists of a large number of phosphor strips, luminescing in red, green and blue, approximately 0.13 mm wide, the longitudinal direction of which is at right angles to the plane of the drawing of FIG. 1. During normal operation the phosphor strips are vertical and FIG. 1, hence, is a sectional view of the tube at right angles to the phosphor strips. The colour selection means or shadow mask has a large number of apertures 9 which are shown only diagrammatically in FIG. 1. The three electron beams 3, 4 and 5 pass through the apertures 9 at a small angle to each other (the so-called colour selection angle) and consequently each impinges only upon phosphor strips of one colour. The apertures 9 in the colour selection means 7 are thus very accurately positioned relative to the phosphor strips of the display screen 6.

In conventional shadow mask tubes, in which the mask consists of a metal plate having circular or slot-like apertures, the electron beams 3, 4 and 5 are not focused while passing through the apertures 9. It has been suggested to use post deflection focusing by means of a potential difference between the colour selection means 7 and the display screen 6 in which, however, annoying effects of secondary electrons are experienced.

In a cathode ray tube made by the method of the invention, a quadrupole lens is formed in each aperture of the colour selection means 7. FIG. 2 shows, diagrammatically, such a quadrupole lens with a portion of the colour selection means 7 and one of the apertures 9. The potential variation along the edge of aperture 9 is +, −, +, − so as to form a quadrupole field with the orientation shown in FIG. 2, the electron beam passing through the aperture 9 is focused in the horizontal plane and is defocused in the vertical plane so that an electron spot 10 is formed on the display screen when the latter is exactly at the horizontal focus. It is, however, recommended not to focus the beam exactly on the display screen 6 so that a slightly wider electron spot is obtained. There is only a minor effect on the focusing due to passage of the electron beam through the aperture 9 at a small angle. As a result of this, the colour selection of the three electron beams 3, 4 and 5 takes place in a manner quite analogous to that in known conventional shadow mask tubes. As a result of the strong focusing, however, the aperture 9 may be much larger than in conventional shadow masks, so that many electrons impinge upon the display screen 6 and a brighter picture is obtained. The defocusing in the vertical direction does not adversely affect the operation of the tube since the phosphor strips extend parallel to the longitudinal direction of the spot 10.

FIGS. 3*a, b* and *c* diagrammatically show how a plate provided with a relief and used in the method of the invention can be obtained by etching. FIG. 3*a* is a plan view of a portion of such a plate, FIG. 3*b* is the associated sectional view and FIG. 3*c* is a perspective view of the finished plate. The portions of a metal plate 11 which are not be etched away are covered with an etchant-resistant material 12 which is provided on the plate in the desired pattern. The relief pattern shown in FIG. 3*e* is now obtained by etching. The finished plate has a plurality of ridges 13, for example, approximately 100 μm thick which are separated by a strip-shaped regions 14 having a smaller thickness, for example, 30 μm. The relief pattern can also be provided by moulding it in the plate, by spark erosion or by a rolling process.

In FIG. 4, two plates, such as those shown in FIG. 3*c* are secured together with the ridges 13 facing each other. It is also possible to secure the plates together with the ridges remote from each other. In certain cases this may even be more favourable since the plates can more easily be bent in a direction at right angles to the direction of the ridges. The connection is effected by means of an insulator 15 in a manner such that the plates do not contact each other as will be explained hereinafter. By etching away the strip-shaped regions 14, the cross grid shown in FIG. 5*a* is obtained which consists of two sets of parallel conductive strips 16 and 17 which are separated from each other at the crossing by an insulator 15 and which are screwed together. The provision of the insulator 15 will be described hereinafter.

FIG. 5*b* shows the operation of such a cross grid. The colour selection means 7 consist of two sets of parallel conductive strips. As shown, one set is formed by the horizontal conductive strips 17 and the second set by the vertical conductive strips 16. Together the conductors of the two sets define one of the apertures 9. The strips 16 are insulated from the strips 17 by means of an insulator 15. On the display screen 6, the three phosphor strips associated with the aperture 9 are indicated by R (red), G (green), and B (blue). The Figure shows only a few rays of the central electron beam 4 which form the electron spot 10 on the phosphor strip G. The horizontal conductive strips 17 are connected together and are at a higher potential than the interconnected conductive strips 16 so that a quadrupole lens (shown diagrammatically in FIG. 2) is formed in each aperture 9.

The following results were obtained with colour selection means of the construction shown in FIG. 5 mounted in a display tube. In this construction the conductive strips 16 and 17 had a width of 0.24 mm and a mutual pitch of 0.80 mm so that the transmittance of the colour selection means was approximately 50%. With the display screen 6 at a potential of 25 KV, the horizontal conductors at a potential of 25.5 KV and the vertical conductors at a potential 24.5 kV, the focal distance of the quadrupole lenses was 18.0 mm in the center of the display screen with perpendicular incidence and 12.7 mm with an incidence at 37° in the corners of the display screen. The distance between the colour selection means 7 and the display screen 6 was 15 mm in the center and 10 mm at the edge so that the focus of the quadrupole lens was everywhere just slightly beyond the display screen. As a result of this, a so-called focus ring was not visible on the display screen. The electron spots are 0.10 mm wide in the center of the display screen and 0.09 mm in the corners. A suitable width for phosphor strips R, G and B was found to be 0.13 mm. The remainder of the display screen surface may or may not be coated with a light-absorbing material.

FIGS. 6*a* and *b* and FIGS. 7*a, b* and *c* are sectional views of a number of possible shapes for the relief patterns. With the relief pattern shown in FIG. 7*a*, strip-shaped conductors with edges 20 can be obtained as shown in FIG. 7*b*. These edges are chosen to be such that the electron beams passing through the apertures 9 do not touch the insulation material in order to prevent charging of the insulator at the crossings by the electron beam. In addition, this construction prevents barium from a barium getter in the cathode ray tube from depositing on and shortcircuiting the insulation material.

A particularly suitable insulator 15 both for securing together the conductive strips 16 and 17 and for securing a set of conductive strips to an apertured metal plate is glass. Advantageously, the glass is provided in powder form and is then converted into solid glass by heating. The glass powder may be provided by spraying it on the plate, the places not to be coated being screened by means of a template. Alternatively the glass powder may be provided by means of a silk-screening process, by settling (depositing in a bath) or by securing the glass powder against the metal plate by means of a tape with glass powder. It is also possible to provide glass in foil or sheet form and to heat the plates with the sheet therebetween so that the glass adheres to the plate. After removal of the strip-shaped regions, the excess glass is removed, for example, by etching or powder blasting.

FIG. 8 shows diagrammatically a particularly suitable method for providing the glass powder 18, namely electrophoretic coating. The electrophoresis bath 21 contains a liquid, preferably an alcohol 23, for example, methanol in which glass powder 18 is suspended and two electrodes 22 and 24. Electrode 24 is formed by the ridged plate which is to be coated with glass powder 18. The glass particles are charged electrically in that ions of a suitable electrolyte present in the bath adhere to the glass particles. Dependent on the positive or negative charge, a given voltage is applied between the electrodes 22 and 24 so that the glass particles 18 will move towards the electrode 24. The portions not to be coated are covered with a layer of suitable insulator 19, for example, methacrylate resin, polyimide, beeswax or paraffin. With a voltage of approximately 100 volts between the electrodes 22 and 24 an electrode spacing of 1 cm, a layer of glass powder 18 approximately 60 μm thick would be deposited on an electrode surface of 10 sq. cm in 90 seconds.

By etching away, dissolving, evaporating on removing the insulator 19 in a different manner and converting the glass powder into solid glass by heating, a ridged plate is obtained which has a relief and a layer of solid glass on the ridges. Such a plate may then be placed against an apertured plate or against another plate having a relief, as has been described above. When the insulator 19 is a polyimide, it can be readily dissolved in a solution of approximately 10 normal solution lye, preferably KOH, or in $N_2H_4$. $H_2O$ (hydrazine hydrate).

In FIG. 9, two ridged plates coated with glass in the above-described manner are placed one on top of the other. The shape of the relief pattern is approximately the same as that shown in FIG. *7a*. The plates are then secured together by heating. Upon removal of the strip-shaped regions 14, for example, by etching, the grid is shown in FIG. 10 is obtained. Alternatively it is possible to secure the plates together with the ridges remote from each other instead of, as in FIG. 9, with the ridges facings each other. In that case the glass powder should be applied on the flat surfaces 25 and this may also be done non-electrophotoretically.

The securing of the plates in the case of glass insulator will, as a rule, be carried out at a high temperature. Dependent on the kind of glass and the material of the plates, this will be done in a reducing or oxidizing atmosphere. In order to contact the reducing or oxidizing atmosphere with the insulator it is recommended to provide the plate or plates with a number of apertures 26 as is shown in FIG. 11. The apertures 26 are also desired when a synthetic foil wetted with an adhesive is used as an insulator, but in this case they serve to permit escape of any gases formed during heating. Such gases occur notably when a polymide of 4-4' diaminodiphenyl ether and 1, 2, 4, 5 benzenetetracarbonic acid diahydride foil is used which is wetted with a solution of a polyimide of the same materials. The gases are formed during polymerisation in which the polyamide is converted into the polyimide.

Since the plates should not contact each other during assembly, suction plates may be used for this purpose the operation of which, will be explained with reference to FIG. 14. The suction plate 34 is stainless steel and has a thickness of a few cms. It is tension free and has the correct shape and flatness within the desired accuracy. The suction plate is provided with a number of slots 35 which communicate with a vacuum line 36 via a duct. The plates 34 are positioned against the ridged plates and maintain the desired spacing therebetween by suction. The assembly is then heated to a temperature which is sufficiently high for the insulation material to adhere to the plates.

As shown in FIGS. 12 and 13 which are sectional views through two plates 27 and 28 each having a relief and secured together at an angle of 90°, the correct distance can also be obtained by using spacing elements between the plates. The spacers may be in the form of a sphere 29 or a rod 30, respectively, which spheres or rods are removed together with the strip shaped regions.

FIG. 15*a* is a sectional view of a portion of a plate having a relief pattern at least the surface portion of which consists of aluminium. By anodlizing the aluminum surface portions 31 of the ridges 13, the aluminium at those areas is converted into an $Al_2O_3$ layer 31 which, as is known, is an insulator. Another plate 32 is secured against the anodized layers and the strip-shaped regions are removed (FIG. 15*a*). Plate 32 may also be a plate having a relief pattern or may be an apertured palte. In order to ensure the screening of the electron beams from the earth's magnetic field, at least one of the plates of the colour selection means 7 preferably consists of a ferromagnetic material, for example Fe, Co, Ni or alloys of or with these metals.

Figure 16B:
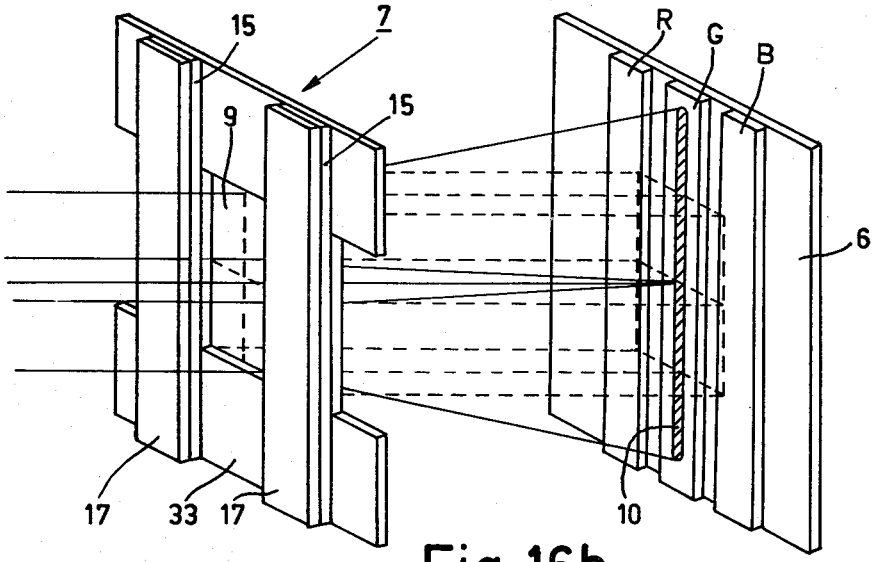

FIGS. 16*a* and *b* show a portion of colour selection means which comprises a plate 33 having apertures 9. A plate having a relief is secured against plate 9 by means of an insulator 15 so that the ridges 13 are disposed between the apertures 9. By removing the strip-shapes regions 14, the colour selection means shown in FIG. 16*a* is obtained. The operation thereof is shown in FIG. 16*b*. The three phosphor strips associated with the aperture 9 are shown on the display screen 6 in the same manner as in FIG. 5*b*. The conductive strips 17 are connected together and are at a lower potential than the plate 33 so that the desired quadrupole lens is formed in the aperture which converges the electron beam into a spot 10.

A display screen for a tube according to the invention can be manufactured by means of a known exposure method in which the colour selection means are displayed on a photosensitive layer on a window portion of the tube. Small variations in the distance between the conductive strips of set 16 causes defects in the width of the phosphor strips. The method according to the invention prevents such variations since daring manufacture of the colour selection means, the distance between the conductive strips (ridges 13) is fixed by the strip-shaped regions 14.

Because of the image transmittance of the colour selection means of the invention, the exposure method used should be suitable to display the aperture 9 which are considerably narrower than the apertures themselves in order to obtain phosphor strips of the correct width. An exposure method suitable for this purpose uses two or more light sources at some distance from each other, as described in German patent application No. 2,248,878. Of course, electronic exposure in which the sensitive layer on the window portion is "exposed" by means of an electron beam are also very suitable for making display screen for the tube of the invention.

It will be obvious that constructions in which more than two plates are secured together with the interposition of an insulator also fall within the scope of the present invention. According to the method of the invention, for example, two plates having a relief pattern may be secured against a plate having apertures 33 as shown in FIG. 16*a*, so that a set of parallel strips is formed on two sides of the appertured plate. Very symmetrical quadrupole lenses can be obtained with such a construction.

We claim:

1. In the manufacture of a colour cathode ray tube having an apertured shadow mask comprising an electrode structure for producing an electron field in the mask apertures, the method comprising the steps of securing a first electrically conductive plate having a plurality of parallel ridges joined together by relatively thin strips to a second electrically conductive plate having a plurality of apertures aligned with said strips by insulating material interposed between said plates to thereby form an electrode structure, removing at least portions of said strips to form in said first plate elongated apertures which are aligned with the apertures in said second plate to thereby form in said electrode structure openings for passage of electron beams, and mounting said electrode structure in an envelope of said tube.

2. The method according to claim 1, wherein said step of removing includes etching through said strips to form said elongated apertures after said securing step.

3. The method according to claim 2, wherein prior to said securing step said apertures in said second plate are formed by etching.

4. The method according to claim 1, wherein said insulating material is glass and said step of securing includes heating said plates with said glass interposed therebetween to a temperature sufficient for said glass to adhere to said plates.

5. The method according to claim 4, wherein said glass is in the form of a powder and including, prior to said securing step, the steps of applying said powder to the surface of one of said plates that is to face the other of said plates, and heating said one plate and said glass powder thereon to form, from said powder, a solid glass mass, said method further including the step of removing excess glass after said first-named removing step.

6. The method according to claim 1, wherein the surface of one of said plates adjacent the other plate is aluminum and including the step of anodizing said aluminum to form aluminum oxide which forms said insulating material.

7. The method according to claim 1, wherein said removing step includes removing the central portions of said strips and retaining edge portions thereof to shield said insulating material.

8. The method according to claim 1, wherein said insulating material is a refractory synthetic sheet and including the steps of positioning said sheet between said plates prior to said securing step and removing portions of said sheet which are not in surface to surface contact with both of said plates after said first-named removing step.

9. The method according to claim 8, including the step of applying onto at least one surface of said sheet, an adhesive of the same composition as the material of said sheet.

10. The method according to claim 9, wherein said sheet is polyimide.

11. The method according to claim 10, wherein said step of applying includes the step of wetting said one surface of said sheet with a solution of polyamide and converting the polyamide on said sheet into polyimide by heating.

12. The method according to claim 11, wherein said polyimide is 4-4' diaminodiphenyl ether and 1-2-4-5 benzenetetracarbonic acid dianydride.

13. The method according to claim 1, wherein said second plate has a plurality of relatively thick, parallel ridges joined together by relatively thin strips, and including the steps of orienting said first and second plates so that the ridges of said second plate are substantially perpendicular to the ridges of said first plate prior to said securing step and removing at least portions of said strips in said second plate to form apertures therethrough.

14. The method according to claim 13, wherein said step of securing includes heating said plates with said insulating material interposed therebetween to a temperature sufficient for said insulating material to adhere to said plates and including the step of inserting a spacer between said plates prior to said heating step to maintain a predetermined spacing between said plates during said heating step, cooling said plates to a temperature at which said insulating material hardens and thereafter removing said spacer.

15. In the manufacture of a colour cathode ray tube having an apertured shadow mask comprising an electrode structure for producing an electron focusing field in the mask apertures, the method comprising the steps of: producing a first metal plate comprising a plurality of relatively thick ridges joined together by relatively thin strips; covering said plate, except for said ridges which are kept uncovered, with insulating means; electrophoretically coating said ridges with glass powder; removing said insulating means, heating said plate and said glass powder to convert said powder into a solid; securing said first plate to a second apertured metal plate insulated from said first plate by said glass on said ridges with the apertures in said second plate being aligned with said strips to thereby form said electrode structure; removing at least portions of said strips to form in said first plate elongated apertures which are aligned with the apertures in said second plate to thereby form in said electrode structure openings for passage of electron beams, and mounting said electrode structure in an envelope of said tube.

16. The method of claim 15, wherein the step of electrophoretically coating includes the steps of suspending said glass powder in alcohol to form an electrophoresis bath.

17. In the manufacture of a colour cathode ray tube having an apertured shadow mask comprising an electrode structure for producing an electron focusing field in the mask apertures, the method comprising the steps of positioning a first electrically conductive plate having a plurality of parallel ridges joined together by relatively thin strips in substantially parallel, face to face relationship with a second electrically conductive plate having a plurality of apertures aligned with said strips, interposing an insulating material between said plates, adhering said plates to said insulating material to form said electrode structure comprising said plates spaced a predetermined distance from each other by said insulating material therebetween, removing at least portions of said strips to form, in said first plate, elongated apertures which are aligned with said apertures in said second plate to thereby form, in said electrode structure, openings for passage of electron beams, and mounting said electrode structure in an envelope of said tube.

18. The method according to claim 17, wherein said insulating material is glass and said step of adhering includes the steps of maintaining said plates spaced said predetermined distance from each other and, simultaneously with said maintaining step, heating the assembly formed by said plates and said glass interposed therebetween to a temperature sufficient for said glass to adhere to said plates and subsequently cooling the assembly to a temperature at which said glass hardens sufficiently to maintain said plates spaced by said predetermined distance.

* * * * *

UNITED STATES PATENT AND TRADEMARK OFFICE

CERTIFICATE OF CORRECTION

PATENT NO. : 4160311

DATED : July 10,1979

INVENTOR(S) : HUBERTUS J. RONDE ET AL

It is certified that error appears in the above-identified patent and that said Letters Patent are hereby corrected as shown below:

Claim 1, line 61, after "electron" insert --focusing--

Signed and Sealed this

*Twenty-fifth* Day of *March 1980*

[SEAL]

*Attest:*

SIDNEY A. DIAMOND

*Attesting Officer*

*Commissioner of Patents and Trademarks*